US011315486B1

(12) United States Patent
Su et al.

(10) Patent No.: US 11,315,486 B1
(45) Date of Patent: Apr. 26, 2022

(54) IMAGE PROCESSING CIRCUIT AND IMAGE PROCESSING METHOD WITH OVERDRIVING ILLUMINATION ELEMENT

(71) Applicant: NOVATEK Microelectronics Corp., Hsinchu (TW)

(72) Inventors: Shang-Yu Su, Hsinchu County (TW); Xuan-Yong Lin, Hsinchu (TW); Feng-Ting Pai, Hsinchu (TW)

(73) Assignee: NOVATEK Microelectronics Corp., Hsinchu (TW)

( * ) Notice: Subject to any disclaimer, the term of this patent is extended or adjusted under 35 U.S.C. 154(b) by 0 days.

(21) Appl. No.: 17/121,771

(22) Filed: Dec. 15, 2020

Related U.S. Application Data

(60) Provisional application No. 63/087,313, filed on Oct. 5, 2020.

(51) Int. Cl.
*G09G 3/3208* (2016.01)

(52) U.S. Cl.
CPC ... *G09G 3/3208* (2013.01); *G09G 2300/0452* (2013.01); *G09G 2320/0626* (2013.01)

(58) Field of Classification Search
CPC ..... G09G 3/3208; G09G 2300/0452; G09G 2320/0626
See application file for complete search history.

(56) References Cited

U.S. PATENT DOCUMENTS

| | | | | |
|---|---|---|---|---|
| 2005/0083353 | A1* | 4/2005 | Maruyama | G09G 3/3611 345/690 |
| 2005/0111046 | A1 | 5/2005 | Kurumisawa et al. | |
| 2006/0267893 | A1 | 11/2006 | Kim et al. | |
| 2008/0204482 | A1 | 8/2008 | Kim | |
| 2011/0063337 | A1* | 3/2011 | Lin | G09G 3/3648 345/690 |
| 2014/0176617 | A1* | 6/2014 | Jeong | G09G 3/2003 345/690 |
| 2017/0358257 | A1* | 12/2017 | Lin | G09G 3/32 |
| 2018/0374450 | A1* | 12/2018 | Kanovsky | G09G 5/395 |
| 2019/0172895 | A1* | 6/2019 | Liu | H01L 27/3211 |
| 2019/0189082 | A1* | 6/2019 | Shehata | G06T 11/001 |
| 2020/0265788 | A1* | 8/2020 | Kim | G09G 3/2003 |

* cited by examiner

*Primary Examiner* — Premal R Patel
(74) *Attorney, Agent, or Firm* — CKC & Partners Co., LLC

(57) ABSTRACT

An image processing circuit is configured to generate a first offset value according to second offset values in at least one look-up table corresponding to a starting voltage range of at least one illumination element in a display device. The image processing circuit is further configured to generate output image data according to an ending gray level value and the first offset value. The output image data is for overdriving the at least one illumination element. The second offset values correspond to a starting gray level value of a first frame and the ending gray level value of a second frame.

20 Claims, 9 Drawing Sheets

LUT1

| staring gray level value (SG) | ending gray level value (EG) | | | | | | | | |
|---|---|---|---|---|---|---|---|---|---|
| | 0 | 32 | 64 | 96 | 128 | 160 | 192 | 224 | 255 |
| 0 | 0 | | | | | | | | |
| 32 | | 0 | | | | | | | |
| 64 | | | 0 | | | | | | |
| 96 | | | | 0 | | | | | |
| 128 | | | | | 0 | | | | |
| 160 | | | | | | 0 | | | |
| 192 | | | | | | | 0 | | |
| 224 | | | | | | | | 0 | |
| 255 | | | | | | | | | 0 |

SG1
SG2
OF1
EG1
EG2
OF2
OF4
OF3

FIG. 4

LUT1

| staring gray level value (SG) | ending gray level value (EG) | | | | | | | | |
|---|---|---|---|---|---|---|---|---|---|
| | 0 (EG1) | 32 (EG2) | 64 | 96 | 128 | 160 | 192 | 224 | 255 |
| 0 | 0 | | | | | | | | |
| 32 | | 0 | | | | | | | |
| 64 | | | 0 | | | | | | |
| 96 | | | | 0 | | | | | |
| 128 (SG1) | 10 | 7 | | | 0 | | | | |
| 160 (SG2) | 15 (OF1) | 9 (OF2) | | | | 0 | | | |
| 192 | | | | | | | 0 | | |
| 224 | | | | | | | | 0 | |
| 255 | | | | | | | | | 0 |

OF3 OF4

FIG. 5

IMAGE PROCESSING CIRCUIT AND IMAGE PROCESSING METHOD WITH OVERDRIVING ILLUMINATION ELEMENT

RELATED APPLICATIONS

This application claims priority to U.S. Provisional Application Ser. No. 63/087,313, filed Oct. 5, 2020, which is herein incorporated by reference.

BACKGROUND

Technical Field

The present disclosure relates to the image processing technology. More particularly, the present disclosure relates to an image processing circuit and an image processing method.

Description of Related Art

With developments of technology, an overdriving process is often performed on an image for expediting a response time of a display device. In some related approaches, only one look-up table is used for overdriving all illumination elements in the display device. However, this look-up table may be not suitable for some illumination elements in the display device.

SUMMARY

Some aspects of the present disclosure are to provide an image processing circuit. The image processing circuit is configured to generate a first offset value according to second offset values in at least one look-up table corresponding to a starting voltage range of at least one illumination element in a display device. The image processing circuit is further configured to generate output image data according to an ending gray level value and the first offset value. The output image data is for overdriving the at least one illumination element. The second offset values correspond to a starting gray level value of a first frame and the ending gray level value of a second frame.

Some aspects of the present disclosure are to provide an image processing method. The image processing method includes following operations: generating a first offset value according to second offset values in at least one look-up table corresponding to a starting voltage range of at least one illumination element in a display device; and generating output image data according to an ending gray level value and the first offset value, to overdrive the at least one illumination element, in which the second offset values correspond to a starting gray level value of a first frame and the ending gray level value of a second frame.

BRIEF DESCRIPTION OF THE DRAWINGS

The disclosure can be more fully understood by reading the following detailed description of the embodiment, with reference made to the accompanying drawings as follows:

FIG. 4 is a schematic diagram illustrating a look-up table according to some embodiments of the present disclosure.

FIG. 5 is a schematic diagram illustrating a look-up table according to some embodiments of the present disclosure.

DETAILED DESCRIPTION

The embodiments in the following descriptions are described in detail with the accompanying drawings, but the examples provided are not intended to limit the scope of the disclosure covered by the present disclosure. The structure and operation are not intended to limit the execution order. Any structure regrouped by elements, which has an equal effect, is covered by the scope of the present disclosure. In addition, the drawings are merely for illustration and are not illustrated according original sizes. For ease of understanding, the same or similar components in the following descriptions will be described with the same symbols.

In the present disclosure, "connected" or "coupled" may refer to "electrically connected" or "electrically coupled." "Connected" or "coupled" may also refer to operations or actions between two or more elements.

Figure 1:
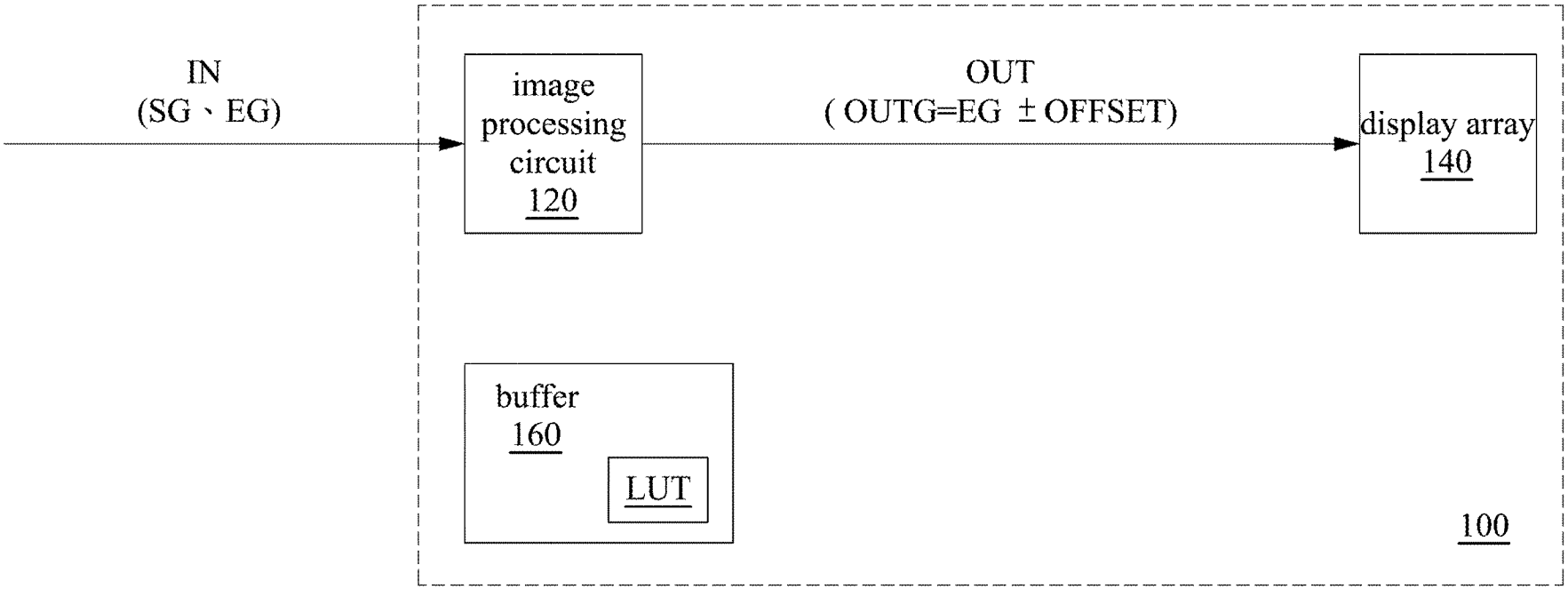
FIG. 1 is a schematic diagram illustrating a display device according to some embodiments of the present disclosure.

Reference is made to FIG. 1. FIG. 1 is a schematic diagram illustrating a display device 100 according to some embodiments of the present disclosure. As illustrated in FIG. 1, the display device 100 includes an image processing circuit 120, a display array 140, and a buffer 160.

The display array 140 is coupled to the image processing circuit 120. The display array 140 includes multiple illumination elements. The illumination elements have different starting voltage ranges respectively due to different material characteristics, different structures, different drivers, or other different factors. In some embodiments, a starting voltage of an illumination element is a minimum turned-on voltage of the illumination element. For example, the illumination elements include red OLEDs, green OLEDs, and blue OLEDs, these different color OLEDs have different minimum turned-on voltage ranges respectively. In some embodiments, the minimum turned-on voltage of a blue OLED is greater than the minimum turned-on voltage of a red OLED, and the minimum turned-on voltage of the red OLED is greater than the minimum turned-on voltage of a green OLED.

It is noted that the implementations (for example, OLEDs) of the illumination elements above are merely for illustration, and other illumination elements are with the contemplated scopes of the present disclosure.

The buffer 160 is coupled to the image processing circuit 120. The buffer 160 is configured to store multiple look-up tables LUT. The look-up tables LUT are for overdriving illumination elements with different starting voltage ranges, to expedite the response time of the illumination elements. For example, the buffer 160 stores three look-up tables LUT, and the three look-up tables LUT are used for red OLEDs, green OLEDs, and blue OLEDs respectively. Each of the look-up tables LUT records original offset values. Each of the original offset values is used to overdrive the corresponding illumination elements when the illumination elements change from a first frame to a second frame, and the each of the original offset value refers to an overdriving amount.

Figure 2:
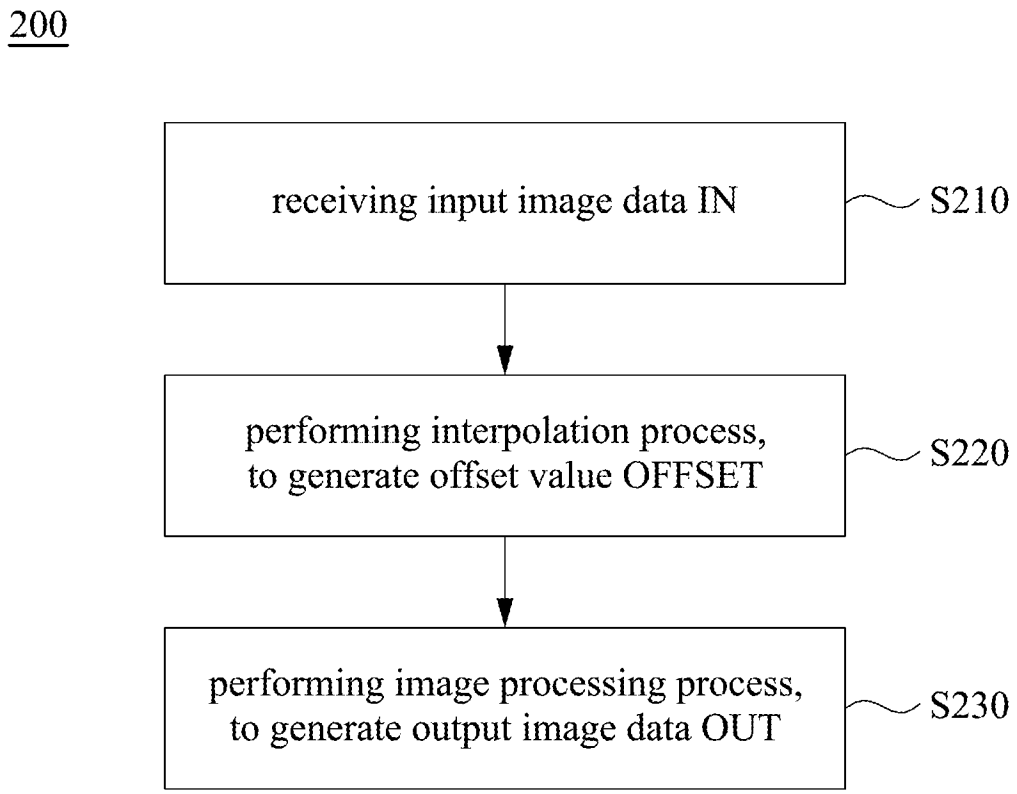
FIG. 2 is a flow diagram illustrating an image processing method according to some embodiments of the present disclosure.

Reference is made to FIG. 2. FIG. 2 is a flow diagram illustrating an image processing method 200 according to some embodiments of the present disclosure. In some embodiments, the image processing method 200 is applied to the display device 100 in FIG. 1. As illustrated in FIG. 2, the image processing method 200 includes operations S210, S220, and S230. The image processing method 200 is described in following paragraphs with reference to FIG. 1.

In operation S210, the image processing circuit 120 is configured to receive input image data IN. The input image data IN includes a starting gray level value SG of the first frame and an ending gray level value EG of the second frame. In some embodiments, the starting gray level value SG and the ending gray level value EG may be stored in the buffer 160.

In operation S220, the image processing circuit 120 is further configured to perform an interpolation process (for example, a bilinear interpolation process) based on the look-up tables LUT, to generate one or more offset values OFFSET. For example, the image processing circuit 120 determines multiple original offset values in the look-up tables LUT according to the starting gray level value SG and the ending gray level value EG. Then, the image processing circuit 120 performs the interpolation process (for example, the bilinear interpolation process) on the determined original offset values to generate the offset values OFFSET. How to perform the bilinear interpolation process on the determined original offset values to generate the offset values OFFSET will be described in following paragraphs with reference to FIG. 4 and FIG. 5.

In operation S230, the image processing circuit 120 is further configured to perform an image processing process, to generate output image data OUT. For example, the image processing circuit 120 generates output gray level values OUTG of the output image data OUT according to the ending gray level value EG and the offset values OFFSET.

Figure 3:
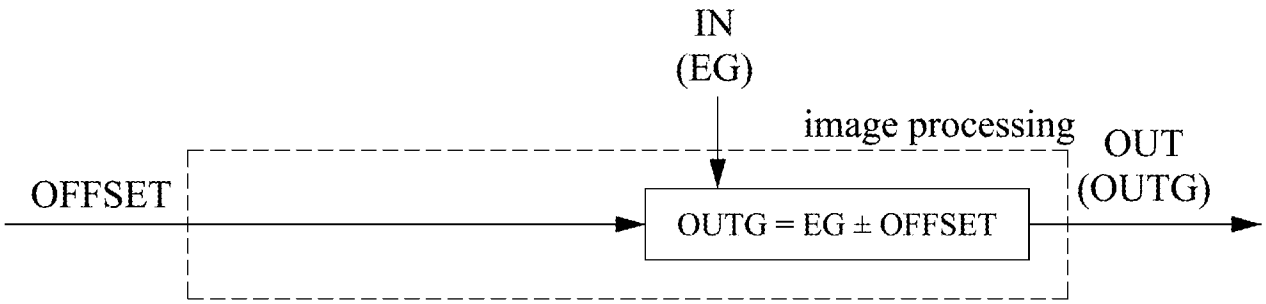
FIG. 3 is a schematic diagram illustrating generating output image data according to some embodiments of the present disclosure.

Reference is made to FIG. 3. FIG. 3 is a schematic diagram illustrating generating the output image data OUT according to some embodiments of the present disclosure. As illustrated in FIG. 3, the image processing circuit 120 generates the output gray level values OUTG of the output image data OUT according to a sum of the ending gray level value EG and the offset values OFFSET or a difference between the ending gray level value EG and the offset values OFFSET. To be more specific, if the ending gray level value EG is greater than the starting gray level value SG, the image processing circuit 120 generates the output gray level values OUTG by adding the ending gray level value EG and the offset values OFFSET. On the contrary, if the ending gray level value EG is less than the starting gray level value SG, the image processing circuit 120 generates the output gray level values OUTG by subtracting the offset values OFFSET from the ending gray level value EG. The output image data OUT is for overdriving the corresponding illumination elements in the display array 140, to expedite the response time of the illumination elements.

As described above, how to perform the bilinear interpolation process on the determined original offset values to generate the offset values OFFSET will be described in following paragraphs with reference to FIG. 4 and FIG. 5.

Reference is made to FIG. 4. FIG. 4 is a schematic diagram illustrating one look-up table LUT1 according to some embodiments of the present disclosure. The look-up table LUT1 is for an illumination element with a specific starting voltage range. It is assumed the starting gray level value SG is 1, and the ending gray level value EG is 134. In other words, the image is changed from a dark frame to a bright frame. A range between two starting gray level values SG1 and SG2 which covers the starting gray level value SG(1) is determined. The two starting gray level values SG1 and SG2, for example, are 0 and 32 respectively. Similarly, a range between two ending gray level values EG1 and EG2 which covers the ending gray level value EG(134) is determined. The two ending gray level values EG1 and EG2, for example, are 128 and 160 respectively. Based on the two starting gray level values SG1 and SG2 and the two ending gray level values EG1 and EG2, four corresponding original offsets OF1-OF4 are determined. Then, parameters H1 and H2 can be derived from formula (1) and formula (2):

$$H1 = \frac{((EG - EG1) \times 0F2 + (EG2 - EG) \times 0F1)}{(EG2 - EG1)} \quad (1)$$

$$H2 = \frac{((EG - EG1) \times 0F4 + (EG2 - EG) \times 0F3)}{(EG2 - EG1)} \quad (2)$$

Then, the offset value OFFSET can be derived from formula (3):

$$\text{OFFSET} = \frac{(SG - SG1) \times H2 + (SG2 - SG) \times H1}{(SG2 - SG1)} \quad (3)$$

Since it is assumed the starting gray level value SG is 1, and the ending gray level value EG is 134, the offset value OFFSET is calculated based on the look-up table LUT1 and the formula (1)-(3), and the calculated offset value OFFSET is equal to 10.83. In addition, since the image is changed from the dark frame to the bright frame, the sign of the offset value OFFSET is determined to be positive. In other words, when the ending gray level value EG is greater than the starting gray level value SG, the sign of the offset value OFFSET is determined to be positive.

Effectively, the formula (1) and the formula (2) are for horizontal linear interpolation, and the formula (3) is for vertical linear interpolation. The calculations above are called the bilinear interpolation process.

Reference is made to FIG. 5. FIG. 5 is a schematic diagram illustrating the look-up table LUT1 according to some embodiments of the present disclosure. It is assumed the starting gray level value SG is 134, and the ending gray level value EG is 1. In other words, the image is changed from a bright frame to a dark frame. A range between two starting gray level values SG1 and SG2 which covers the starting gray level value SG(134) is determined. The two starting gray level values SG1 and SG2, for example, are 128 and 160 respectively. Similarly, a range between two ending gray level values EG1 and EG2 which covers the ending gray level value EG(1) is determined. The two ending gray level values EG1 and EG2, for example, are 0 and 32 respectively. Based on the two starting gray level values SG1 and SG2 and the two ending gray level values EG1 and EG2, four corresponding original offsets OF1-OF4 are determined.

Since it is assumed the starting gray level value SG is 134, and the ending gray level value EG is 1, the offset value OFFSET is calculated based on the look-up table LUT1 and the formula (1)-(3), and the calculated offset value OFFSET is equal to 10.04. In addition, since the image is changed from the bright frame to the dark frame, the sign of the offset value OFFSET is determined to be negative. In other words, when the ending gray level value EG is less than the starting gray level value SG, the sign of the offset value OFFSET is determined to be negative.

Figure 6:
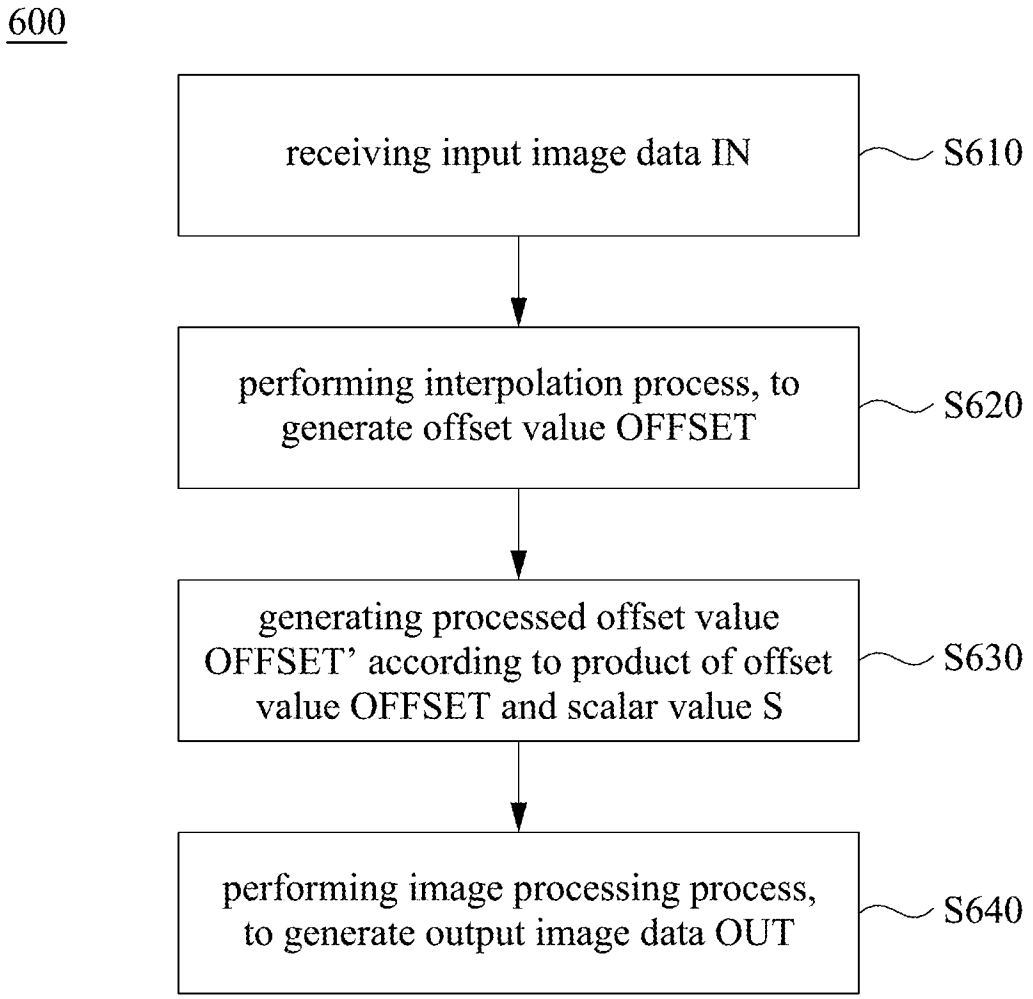
FIG. 6 is a flow diagram illustrating an image processing method according to some embodiments of the present disclosure.

Reference is made to FIG. 6. FIG. 6 is a flow diagram illustrating an image processing method 600 according to some embodiments of the present disclosure. In some embodiments, the image processing method 600 is applied to the display device 100 in FIG. 1. As illustrated in FIG. 6, the image processing method 600 includes operations S610, S620, S630, and S640. The image processing method 600 is described in following paragraphs with reference to FIG. 1.

In operation S610, the image processing circuit 120 is configured to receive the input image data IN.

In operation S620, the image processing circuit 120 is further configured to perform the interpolation process (for example, the bilinear interpolation process) based on the look-up tables LUT, to generate the one or more offset values OFFSET. Since how the image processing circuit 120 performs the bilinear interpolation process is similar to operation S220 and is described above, so it is not described herein again.

In operation S630, the image processing circuit 120 is further configured to generate processed offset value OFFSET' according to a product of the offset value OFFSET and at least one scalar value S.

Figure 7:
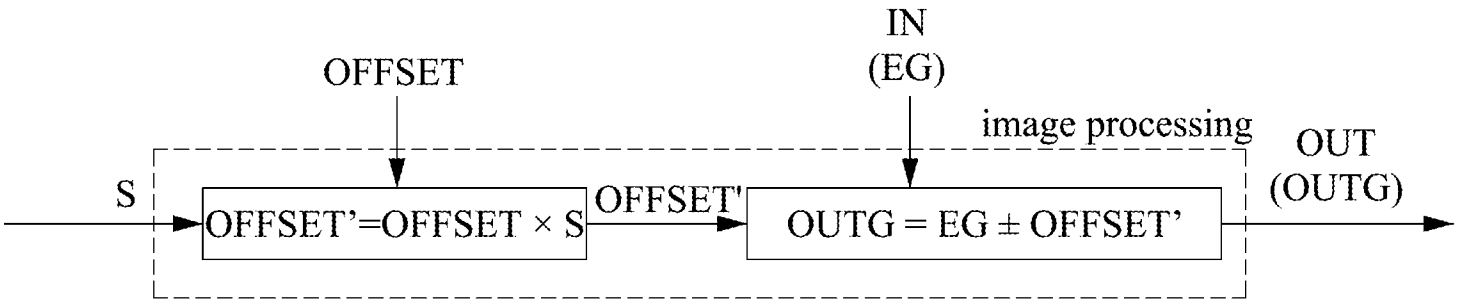
FIG. 7 is a schematic diagram illustrating generating output image data according to some embodiments of the present disclosure.

Reference is made to FIG. 7. FIG. 7 is a schematic diagram illustrating generating the output image data OUT according to some embodiments of the present disclosure. As illustrated in FIG. 7, the image processing circuit 120 generates the processed offset value OFFSET' by multiplying the offset value OFFSET and the scalar value S of at least one corresponding illumination element.

Figure 8:
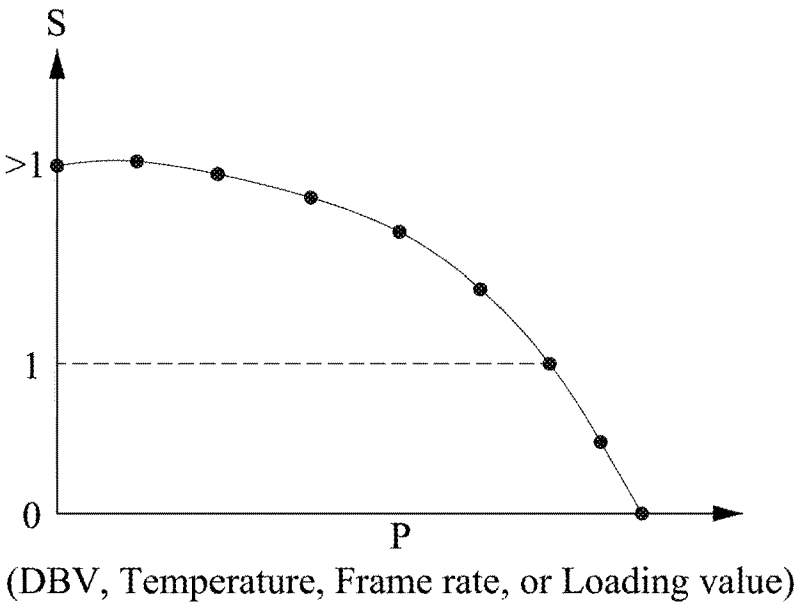
FIG. 8 is a schematic diagram illustrating a scalar value according to some embodiments of the present disclosure.
Figure 8:
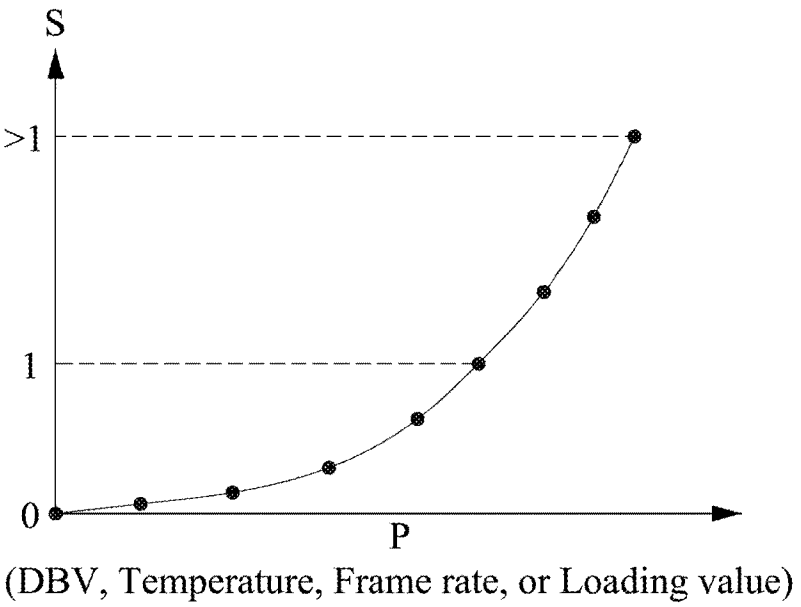

Reference is made to FIG. 8. FIG. 8 is a schematic diagram illustrating the scalar value S according to some embodiments of the present disclosure. As illustrated in FIG. 8, the scalar value S changes with respective to a parameter P of the at least one corresponding illumination element. The parameter P is, for example, a device brightness value (DBV), an operation temperature, a frame rate, or a loading value (LV in FIG. 9) of the at least one corresponding illumination element. In some embodiments, the scalar value S is positively related to the parameter P. In some other embodiments, the scalar value S is negatively related to the parameter P. In some other embodiments, the scalar value S is a fixed value. In addition, the scalar value S may be greater than 1, equal to 1, or less than 1. As illustrated in FIG. 8, a scalar value S corresponding to a specific value of the parameter P may be calculated by performing an interpolate process on two nodes in FIG. 8.

In some embodiments, one or more corresponding illumination elements correspond to multiple scalar values S. Thus, in these embodiments, the image processing circuit 120 generates the processed offset value OFFSET' by multiplying the offset value OFFSET and these scalar values S.

Figure 9:
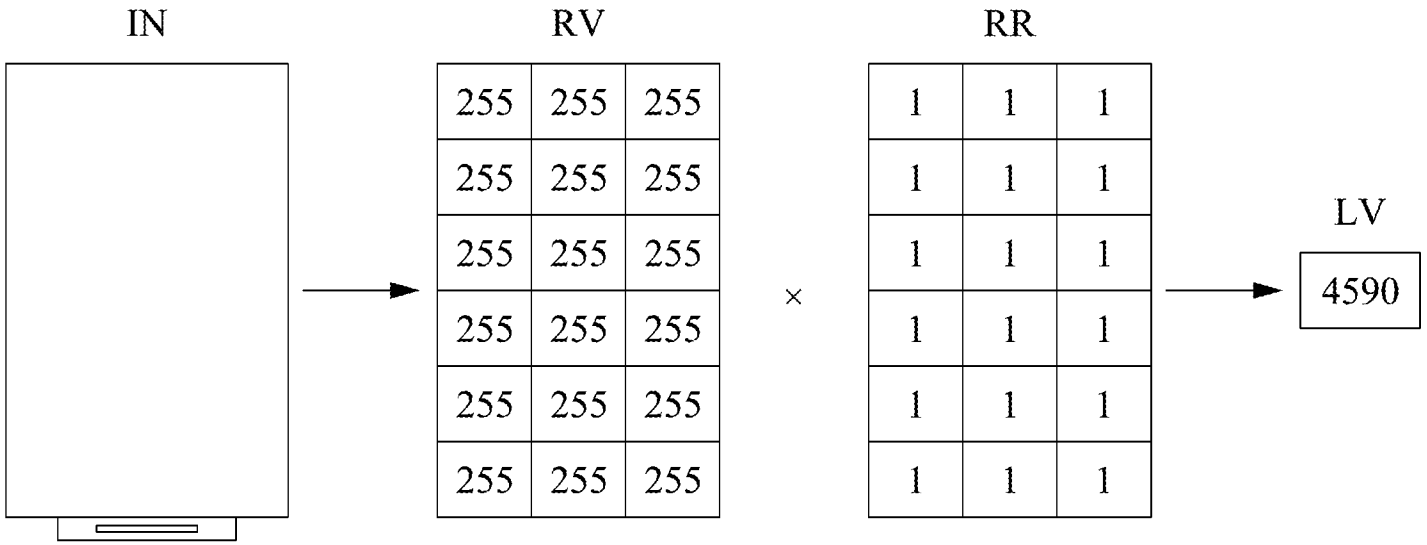
FIG. 9 is a schematic diagram illustrating generating a loading value according to some embodiments of the present disclosure.

In some embodiments, the parameter P is the loading value (LV in FIG. 9). Reference is made to FIG. 9. FIG. 9 is a schematic diagram illustrating generating the loading value LV according to some embodiments of the present disclosure. At first, the pixels in the display array 140 in FIG. 1 are grouped. As illustrated in FIG. 9, the pixels are grouped into 18 blocks. Each one of the blocks is corresponding to a representative value RV and a representative ratio RR. For example, it is assumed that each block includes 4×4 pixels, and the block includes multiple red OLEDs, multiple green OLEDs, and multiple blue OLEDs. The representative value RV of these red OLEDs (or these green OLEDs, or these blue OLEDs) in one block may be a mean value of characteristic values of these red OLEDs (or these green OLEDs, or these blue OLEDs). In some other embodiments, the representative value RV of these red OLEDs (or these green OLEDs, or these blue OLEDs) in one block may be a maximum value or a minimum value of the characteristic values of these red OLEDs (or these green OLEDs, or these blue OLEDs). In some embodiments, the characteristic value is a gray level value, a saturation value, a hue value, a brightness value, a driving voltage, or a driving current. Then, the loading value LV corresponding to these red OLEDs (or these green OLEDs, or these blue OLEDs) is an accumulation value of products of the representative values RV and representative ratios RR of these red OLEDs (or these green OLEDs, or these blue OLEDs). In some other embodiments, the loading value LV of these red OLEDs (or these green OLEDs, or these blue OLEDs) may be a maximum value, a minimum value, or a mean value of products of the representative values RV and the representative ratios RR of these red OLEDs (or these green OLEDs, or these blue OLEDs). In some embodiments, the representative ratios RR may be adjusted before leaving the factory, and may be greater than 1, equal to 1, or less than 1. In other words, the illumination elements with different starting voltage ranges in the pixels in one block are processed separately. In some embodiments, the representative values RV and the loading values LV may be stored in the buffer 160.

In some other embodiments, one group includes the pixels in a line. In some other embodiments, one group includes only one pixel. In the embodiments of one group including one pixel, the representative value RV may be the characteristic value of the illumination element in the pixel. How to generating the loading value LV in these other embodiments is similar to the descriptions above, so it is not described herein again. Compared to the embodiments of one group including one pixel, the embodiments of one group including a line or a block can reduce the number of the representative values RV, so the storage space can be saved.

References are made to FIG. 6 and FIG. 7 again. In operation S640, the image processing circuit 120 is further configured to perform an image processing process, to generate the output image data OUT. For example, the image processing circuit 120 generates the output gray level values OUTG according to the ending gray level value EG and the offset values OFFSET. Since how the image processing circuit 120 performs the image processing process to generate the output image data OUT is similar to operation S230 and is described above, so it is not described herein again.

In some related approaches, only one look-up table is used for overdriving all of different illumination elements of a display device. However, this look-up table may be not suitable for some illumination elements of the display device.

Compared to these related approaches, in the present disclosure, the image processing circuit 120 performs the image processing process according to the look-up table LUT corresponding to the starting voltage range of the corresponding illumination element. In other words, the illumination elements with different starting voltage ranges can be overdriven by using different look-up tables LUT. Thus, a better overdriving effect can be achieved, and the performance of the display device 100 can be better.

Based on the descriptions above, in the present disclosure, a better overdriving effect can be achieved, and the performance of the display device can be better.

Various functional components or blocks have been described herein. As will be appreciated by persons skilled in the art, in some embodiments, the functional blocks will preferably be implemented through circuits (either dedicated circuits, or general purpose circuits, which operate under the control of one or more processors and coded instructions), which will typically comprise transistors or other circuit elements that are configured in such a way as to control the operation of the circuitry in accordance with the functions and operations described herein. As will be further appreciated, the specific structure or interconnections of the circuit elements will typically be determined by a compiler, such as a register transfer language (RTL) compiler. RTL compilers operate upon scripts that closely resemble assembly language code, to compile the script into a form that is used for the layout or fabrication of the ultimate circuitry.

Although the present disclosure has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An image processing circuit configured to generate a first offset value according to second offset values in one of look-up tables, wherein the look-up tables correspond to illumination elements with different starting voltage ranges respectively, wherein the image processing circuit is further configured to generate output image data according to an ending gray level value and the first offset value, wherein the output image data is for overdriving at least one illumination element in the illumination elements, wherein the second offset values correspond to a starting gray level value of a first frame and the ending gray level value of a second frame.

2. The image processing circuit of claim 1, wherein a starting voltage is a minimum turned-on voltage of corresponding illumination element in the illumination elements.

3. The image processing circuit of claim 1, wherein the image processing circuit is further configured to generate the first offset value according to an interpolation process performed on the second offset values.

4. The image processing circuit of claim 1, wherein if the ending gray level value is greater than the starting gray level value, the image processing circuit generates the output image data according to a sum of the ending gray level value and the first offset value, wherein if the ending gray level value is less than starting gray level value, the image processing circuit generates the output image data according to a difference between the ending gray level value and the first offset value.

5. The image processing circuit of claim 1, wherein the image processing circuit is further configured to generate a processed offset value according to a product of the first offset value and at least one scalar value corresponding to the at least one illumination element, and generate the output image data according to the ending gray level value and the processed offset value.

6. The image processing circuit of claim 5, wherein the at least one scalar value is a loading value, and the loading value comprises at least one product of a representative value and a representative ratio, wherein the representative value and the representative ratio are associated with the at least one illumination element.

7. The image processing circuit of claim 6, wherein based on a corresponding starting voltage range of the at least one illumination element, the representative value is a characteristic value of the at least one illumination element, a mean value of characteristic values of a line of the illumination elements, or a mean value of characteristic values of a block of the illumination elements.

8. The image processing circuit of claim 7, wherein the characteristic value or each of the characteristic values is a gray level value, a saturation value, a hue value, a brightness value, a driving voltage, or a driving current.

9. The image processing circuit of claim 5, wherein the at least one scalar value is a loading value, and the loading value is an accumulation value of a plurality of products of representative values and representative ratios, wherein the representative values and the representative ratios are associated with a plurality of corresponding illumination elements in the illumination elements.

10. The image processing circuit of claim 5, wherein the at least one scalar value represents a device brightness value (DBV), an operation temperature, or a frame rate of the at least one illumination element.

11. An image processing method, comprising:

generating a first offset value according to second offset values in one of look-up tables, wherein the look-up tables correspond to illumination elements with different starting voltage ranges respectively; and generating output image data according to an ending gray level value and the first offset value, to overdrive the at least one illumination element in the illumination elements, wherein the second offset values correspond to a starting gray level value of a first frame and the ending gray level value of a second frame.

12. The image processing method of claim 11, wherein a starting voltage is a minimum turned-on voltage of a corresponding illumination element in the illumination elements.

13. The image processing method of claim 11, further comprising:

generating the first offset value according to an interpolation process performed on the second offset values.

14. The image processing method of claim 11, further comprising:

generating the output image data according to a sum of the ending gray level value and the first offset value if the ending gray level value is greater than the starting gray level value; and generating the output image data according to a difference between the ending gray level value and the first offset value if the ending gray level value is less than starting gray level value.

15. The image processing method of claim 11, further comprising:

generating a processed offset value according to a product of the first offset value and at least one scalar value corresponding to the at least one illumination element; and generating the output image data according to the ending gray level value and the processed offset value.

16. The image processing method of claim 15, wherein the at least one scalar value is a loading value, and the loading value comprises at least one product of a representative value and a representative ratio, wherein the representative value and the representative ratio are associated with the at least one illumination element.

17. The image processing method of claim 16, wherein based on a corresponding starting voltage range of the at least one illumination element, the representative value is a characteristic value of the at least one illumination element, a mean value of characteristic values of a line of the illumination elements, or a mean value of characteristic values of a block of the illumination elements.

18. The image processing method of claim 17, wherein the characteristic value or each of the characteristic values is a gray level value, a saturation value, a hue value, a brightness value, a driving voltage, or a driving current.

19. The image processing method of claim 15, wherein the at least one scalar value is a loading value, and the loading value is an accumulation value of a plurality of products of representative values and representative ratios, wherein the representative values and the representative ratios are associated with a plurality of corresponding illumination elements in the illumination elements.

20. The image processing method of claim 15, wherein the at least one scalar value represents a display brightness value, an operation temperature, or a frame rate of the at least one illumination element.

* * * * *